US006086288A

United States Patent [19]

Ruel et al.

[11] Patent Number: 6,086,288

[45] Date of Patent: Jul. 11, 2000

[54] SYSTEMS AND METHODS FOR CONNECTING RETAINING WALL PANELS TO BURIED MESH

[75] Inventors: Steve Ruel; David Swanson, both of San Jose; Scott Thompson, Scotts Valley, all of Calif.

[73] Assignee: SSL, L.L.C., Scotts Valley, Calif.

[21] Appl. No.: 09/026,044

[22] Filed: Feb. 19, 1998

Related U.S. Application Data

[60] Provisional application No. 60/053,034, Jul. 18, 1997, and provisional application No. 60/053,779, Jul. 25, 1997.

[51] Int. Cl.[7] ..... E02D 5/00; E02D 29/02

[52] U.S. Cl. ..... 405/262; 405/284; 405/286

[58] Field of Search ..... 405/262, 284, 405/286, 273, 258, 272

[56] References Cited

U.S. PATENT DOCUMENTS

| | | | |
|---|---|---|---|
| 3,922,864 | 12/1975 | Hilfiker . | |
| 4,068,482 | 1/1978 | Hilfiker . | |
| 4,117,686 | 10/1978 | Hilfiker | 405/284 |
| 4,154,554 | 5/1979 | Hilfiker | 405/273 |
| 4,260,296 | 4/1981 | Hilfiker | 405/7 |
| 4,266,890 | 5/1981 | Hilfiker | 405/286 |
| 4,324,508 | 4/1982 | Hilfiker et al. | 405/284 |
| 4,329,089 | 5/1982 | Hilfiker et al. | 405/262 |
| 4,343,572 | 8/1982 | Hilfiker | 405/284 |
| 4,391,557 | 7/1983 | Hilfiker et al. | 405/287 |
| 4,449,857 | 5/1984 | Davis | 405/286 |
| 4,505,621 | 3/1985 | Hilfiker et al. | 405/284 |
| 4,529,174 | 7/1985 | Pickett | 256/27 |
| 4,616,959 | 10/1986 | Hilfiker | 405/286 |
| 4,643,618 | 2/1987 | Hilfiker et al. | 405/287 |
| 4,661,023 | 4/1987 | Hilfiker | 405/262 |
| 4,684,287 | 8/1987 | Wojciechowdki | 404/6 |
| 4,824,293 | 4/1989 | Brown et al. | 405/262 X |
| 4,834,584 | 5/1989 | Hilfiker | 405/262 |
| 4,856,939 | 8/1989 | Hilfiker | 405/284 |
| 4,929,125 | 5/1990 | Hilfiker | 405/262 |
| 4,992,005 | 2/1991 | Hilfiker | 405/284 |
| 4,993,879 | 2/1991 | Hilfiker | 405/262 |
| 5,076,735 | 12/1991 | Hilfiker | 405/284 |
| 5,259,704 | 11/1993 | ORgorchock | 405/262 |
| 5,484,235 | 1/1996 | Hilfiker et al. | 405/284 |
| 5,492,438 | 2/1996 | Hilfiker | 405/284 |
| 5,494,379 | 2/1996 | Anderson et al. | 405/262 |
| 5,511,910 | 4/1996 | Scales | 405/284 X |
| 5,531,547 | 7/1996 | Shimada | 405/262 |
| 5,647,695 | 7/1997 | Hilfiker et al. | 405/284 |
| 5,722,799 | 3/1998 | Hilfiker | 405/286 X |

FOREIGN PATENT DOCUMENTS

| | | | |
|---|---|---|---|
| 0051424 | 3/1991 | Japan | 405/262 |
| 2059484 | 4/1981 | United Kingdom | 405/262 |

*Primary Examiner*—Dennis L. Taylor
*Attorney, Agent, or Firm*—Michael R. Schacht; Hughes & Schacht, P.S.

[57] ABSTRACT

A retaining wall system and method for stabilizing earthen walls. The system comprises a wall panels assembled together to form a reinforcing wall assembly and anchor mesh connected to the wall panels and buried within the earthen wall. The wall panels engage the face of the earthen wall, and the anchor mesh inhibits lateral movement of the reinforcing wall assembly. The panels are connected to the anchor mesh by locking pins that extend through loop portions of the anchor mesh and engage a front face of the wall panels. Anchor bars are connected to the loop portions of the anchor mesh; these anchor bars engage a back face of the wall panels to control and limit the movement of the wall panels relative to the anchor mesh as earth is back-filled against the wall panels. When the wall panels are concrete, a void network is formed in the panels to receive the anchor mesh loop portions and the locking pins. Pin windows may be formed in concrete wall panels to facilitate insertion of the locking pins.

23 Claims, 14 Drawing Sheets

SYSTEMS AND METHODS FOR CONNECTING RETAINING WALL PANELS TO BURIED MESH

RELATED APPLICATIONS

This application claims priority of U.S. Provisional Application Ser. No. 60/053,034 filed Jul. 18, 1997, and U.S. Provisional Application Ser. No. 60/053,779 filed Jul. 25, 1997.

The present invention relates to retaining wall systems and methods and, more specifically, to such systems and methods that allow structural wall panels to be simply, easily, and securely connected to buried anchor mesh.

BACKGROUND OF THE INVENTION

Construction projects often require the formation of earthen walls having a vertical or nearly vertical face. These walls may be unstable and can collapse when subjected to a variety of natural conditions. For example, heavy precipitation can cause loose earth to fluidize, resulting in collapse of the earthen wall. In another situation, an earthquake will introduce lateral forces that may cause the earthen wall to collapse.

To stabilize such an earthen wall, a retaining wall system may be formed to reinforce the face thereof. At a minimum, the retaining wall system will maintain the shape of the earthen wall should the earth become semi-fluid. Additionally, retaining wall systems may be structurally designed to withstand lateral forces such as those introduced by earthquakes or other external forces or loading conditions.

A retaining wall system comprises a vertical wall portion and an anchor portion. The wall portion physically engages the earthen wall to stabilize the face thereof. The wall portion of a retaining wall may be wood, cast-in-place concrete, concrete panels, wire screen panels, or some combination thereof. The present invention relates to retaining wall systems having a wall portion made of concrete or wire screen panels.

The anchor portion of a retaining wall system ties the retaining wall into the earthen wall to stabilize the retaining wall against lateral forces. Numerous techniques may be used to form such an anchor portion. The present invention relates to retaining walls that include such an anchor portion and, more specifically, to retaining walls having an anchor portion formed of buried wire mesh.

The construction of an earthen wall reinforced by a retaining wall system can represent a significant portion of the costs of a construction project. A continual need thus exists for retaining wall systems and methods that can be implemented at reduced cost.

RELATED ART

A number of patents have been brought to the attention of the Applicants through professional patentability searches, inventor searches, and assignee searches conducted on behalf of the Applicants. The patents uncovered in these searches generally fall into one of three categories.

The first category includes patents that relate to mechanically stabilized earth systems in which, as with the present invention, the panels that form the reinforcing wall are directly connected to anchor mesh or similar buried members. The patents in this first category will each be discussed individually as warranted by their relevancy. The following patents are included in the first category described above.

U.S. Pat. No. 4,324,508 to Hilfiker et al. discloses a retaining wall system in which rods are inserted through folded ends of reinforcing mats and behind pin members extending between adjacent edges of wall panels. The rods engage the pin members to prevent movement of the wall panels relative to the reinforcing mats. The Applicants believe that neither the pin members nor the reinforcing mats of the Hilfiker et al. '508 patent can be practically manufactured with sufficient strength to stabilize the wall under the lateral loads the system must bear. The system described in the Hilfiker '508 patent has not, to the Applicants' knowledge, met with significant commercial success, most likely because this system as designed cannot meet applicable AASHTO specifications.

U.S. Pat. No. 4,329,089 to Hilfiker et al. discloses a wall system in which anchor members are folded over and inserted through grid work sections forming the wall. Pins are inserted through loops formed by the folded anchor members to prevent withdrawal of the anchor members back through the grid work sections. As with the system disclosed in the Hilfiker et al. '508 patent, the system of the Hilfiker '089 patent would not, as designed, meet AASHTO specifications because the system would not be stable under the anticipated loads.

U.S. Pat. No. 5,494,379 to Anderson et al. discloses a wire mesh retaining wall that employs handle bar connectors to attach buried stabilizing members to wire mesh panels. The handle bar connectors are passed through loops formed in the stabilizing members. The loads to which the retaining wall may be subjected may straighten out the loops in the stabilizing members, thus rendering the retaining wall described in the Anderson et. al. patent unstable.

U.S. Pat. No. 4,505,621 to Hilfiker et al. discloses a retaining wall system in which reinforcing mats are comprised of longitudinal wires and cross wires. The longitudinal wires are bent to form floor and face sections and kinked in the face section. The floor sections are buried with a cross wire of one mat engaging longitudinal wires of an adjacent mat such that the face sections form the reinforcing wall. In this system, the retaining mats are integrally formed with the face sections.

U.S. Pat. Nos. 4,616,959 and 4,661,023 to Hilfiker discloses wall systems in which rods are received within grooves in concrete members forming the wall to connect soil reinforcing mats to the concrete members. In the '959 patent, the soil reinforcing mats are folded over the rods. In the '023 patent, the mats are connected directly to the rods.

U.S. Pat. No. 5,484,235 to Hilfiker discloses a wall system in which the soil reinforcing mat is directly received within grooves formed in upper and/or lower edges of the concrete blocks. When one block is stacked on top of another, the mats are trapped within the grooves.

U.S. Pat. No. 4,856,939 to Hilfiker discloses a wall system in which the soil reinforcing mat is in the form of grids that interlock with trays that define the wall. The trays are inserted through the grids to form the connection therebetween.

U.S. Pat. Nos. 4,260,296 and 4,266,890 to Hilfiker disclose wall systems in which vertical pins extend through holes in the wall panels and through plates connected to buried anchor rods; the buried rods stabilize the wall panels.

U.S. Pat. No. 3,922,864 to Hilfiker discloses a wall system in which flanges are threaded onto stretchers extending between a wall panel and a buried deadman.

U.S. Pat. Nos. 4,343,572, 4,643,618, and 4,391,557 discloses wall systems in which the reinforcing wall is cast in place and not formed of precast concrete wall panels.

The second category includes mechanically stabilized earth systems in which inserts are cast into wall panels and the anchor mesh is connected to these inserts. The following references are contained in the second category: U.S. Pat. Nos. 5,492,438, 4,993,879, 4,929,125, 4,834,584, and 4,154,554 to Hilfiker and U.S. Pat. No. 4,449,857 to Davis.

The third category includes systems that are relevant to the present invention as background only. The following references are contained in this third category: U.S. Pat. Nos. 5,076,735, 4,992,005, 4,117,686, and 4,068,482 to Hilfiker, U.S. Pat. No. 5,647,695 to Hilfiker et al., U.S. Pat. No. 4,529,174 to Pickett, U.S. Pat. No. 4,684,287 to Wojciechowski, U.S. Pat. No. 5,531,547 to Shimada.

OBJECTS OF THE INVENTION

From the foregoing, it should be apparent that a primary objective of the present invention is to provide improved systems and methods for reinforcing earthen walls.

Another more specific objective of the present invention is to provide improved systems and methods for reinforcing earthen walls that have a favorable mix of the following characteristics:

effectively stabilize the earthen wall;

control any movement of the reinforcing wall assembly that may occur during formation of the earthen wall; and may be easily and inexpensively implemented.

SUMMARY OF THE INVENTION

These and other objects are obtained by the present invention, which is a retaining wall system or method in which buried anchor mesh is connected to wall panels by locking pins. The anchor mesh is formed with loop portions that extend through at least a portion of the wall panels. The locking pins are inserted through the loop portion so that they engage the wall panels and prevent the loop portions from being withdrawn from their connected position.

To prevent the loop portions of the anchor mesh from straightening under loads created by earth backfilled against the retaining wall, anchor bearing bars are welded to the loop portions of the anchor mesh. These anchor bearing bars engage a back surface of the wall panels to prevent straightening of the anchor mesh loop portions beyond what is required to obtain a stable reinforcing wall system.

The present invention is engineered to allow a limited amount of movement or straightening of these loop portions. If the tolerances of the anchor mesh are too tight, the locking pins may not pass through the loop portions. By allowing a small amount of straightening of the loop portions, these loop portions can be made slightly oversized to allow the locking pins to be inserted therethrough. Then, when earth is backfilled against the retaining wall, the loop portions straighten a small amount until the locking pin is snugly held against the wall panel and the anchor bearing bar is snugly held against the back surface of the wall panel.

The system thus creates a stable reinforcing wall that may be easily assembled.

If the wall panels are made of precast reinforced concrete, a connecting void network is preferably formed therein to receive the loop portions of the anchor mesh and the locking pins. The connecting void network thus comprises a plurality of mesh voids and a pin void in communication with each of the mesh voids. The loop portions are inserted into the mesh voids, and the locking pin is inserted through the loop portions by passing at least partially through the pin void. In this embodiment, the locking assembly is not visible on the front face of the retaining wall. It may be possible to form only the mesh voids and have them extend through the entire face of the wall panel. A separate pin void thus need not be formed, and the pin is simply inserted through the loop portions along the front face of the wall panel. In this case, a pin void is not necessary.

In situations where the loop portions are not intended to extend completely through the wall panel, pin windows may be formed on each side edge of the concrete wall panel such that they communicate with the pin void. When the concrete panels are assembled together to form the reinforcing wall, the pin windows of adjacent panels align with each other. And instead of providing one long locking pin that extends through all of the loop portions, two shorter locking pins that extend through only half of the loop portions may be provided. These shorter locking pins may be laterally inserted into a cavity defined by adjacent pin windows and then displaced along their axes towards each other such that each one passes through half of the loop portions of the anchor mesh.

The process of assembling the entire reinforcing wall and connecting it to the anchor mesh is greatly simplified by the use of the pin windows and two short locking pins as described above.

The connecting system of the present invention is also applicable to wire wall panels. Wire wall panels are rectangular arrays of bars that are welded together. These panels are arranged in a shiplap configuration with the lower edge of an upper panel overlapping an upper edge of a lower panel. The loop portions of the anchor mesh are passed through both of the adjacent wall panels, and the locking pin is inserted through the loop portion such that it directly engages the outermost wall panel and indirectly engages the innermost wall panel.

DETAILED DESCRIPTION OF THE INVENTION

The present invention is a retaining wall system that may be implemented in one of two embodiments. The first embodiment employs precast concrete wall panels. The second embodiment employs wire wall panels. In both embodiments, the present invention relates primarily to the manner in which the wall panels are connected to a buried wire mesh that functions to anchor the wall panels in place. Each of these embodiments, and certain variations thereon, will be discussed separately below.

I. Retaining Wall System Employing Concrete Wall Panels

Referring initially FIGS. 1–15, depicted therein is a portion of a retaining wall system 20 constructed in accordance with, and embodying, the principles of the present invention. The retaining wall system 20 comprises a plurality of retaining wall panels 22 and anchor mesh sections 24.

Figure 2:
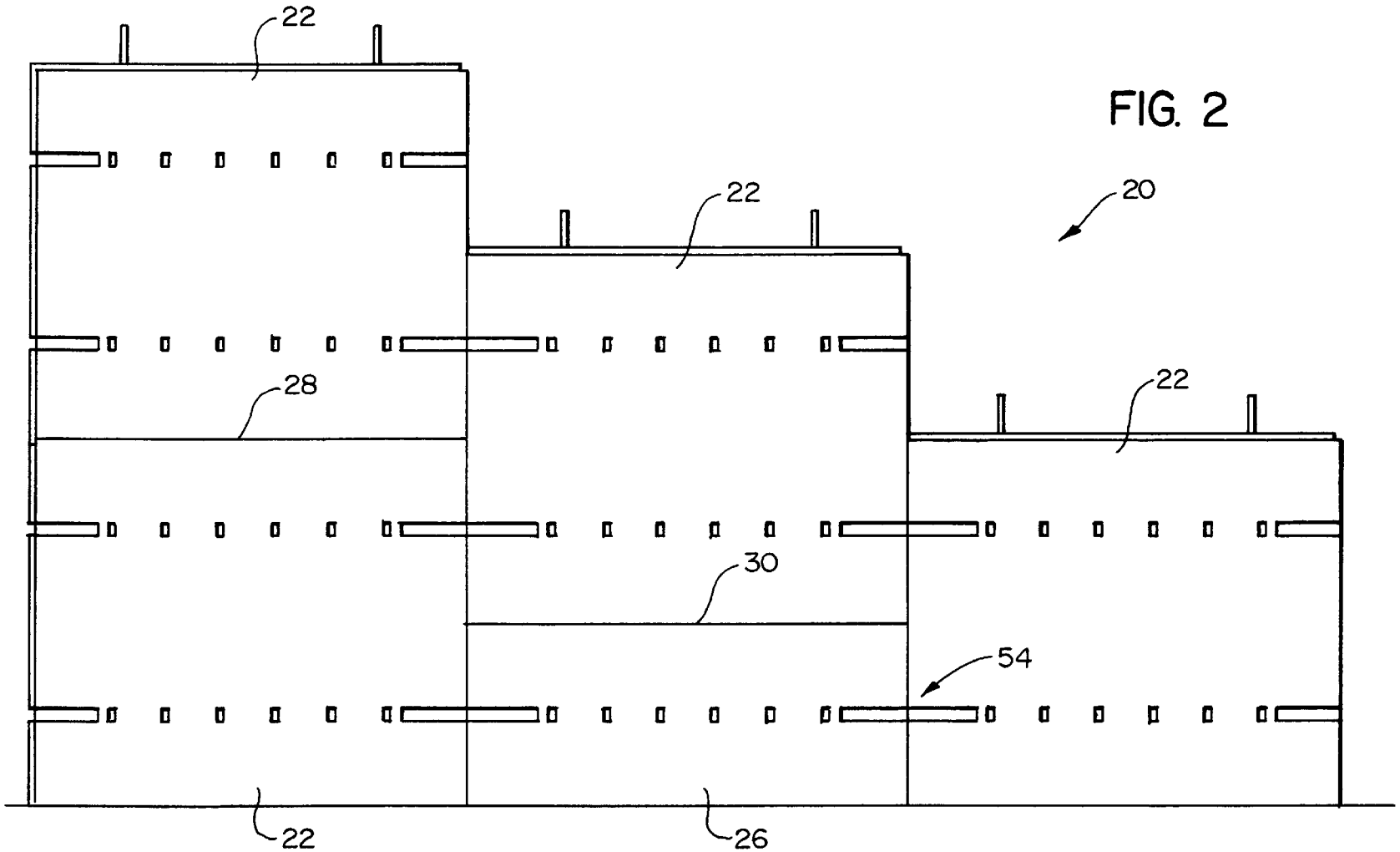
FIG. 2 is a rear elevation view depicting a number of retaining wall panels assembled together to form a retaining wall.

Referring now for moment to FIG. 2, it can be seen that a typical retaining wall system constructed in accordance with present invention will comprise a plurality of retaining wall panels 22. FIG. 2 illustrates that these retaining wall panels are formed in two basic types: in addition to a full-height section such as that indicated by reference character 22, partial-height panels such as the barrier wall section indicated by reference character 26 are provided. In the context of the present invention, the partial-height panels 26 function in almost the same manner as the full-height panels 22; the partial-height panels 26 will therefore be discussed only to the extent that they differ from the full-height panels 22.

When the first course of retaining wall panels is laid, full-height and partial-height panels are alternated as shown in FIG. 2 such that horizontal seams such as those indicated by reference characters 28 and 30 are staggered. Successive courses of wall panels will comprise full-height panels until the top course is reached, at which point full-height and partial-height panels will again be alternated; the upper edges of these panels 22 and 26 define the upper edge of the wall system 20.

Figure 3:
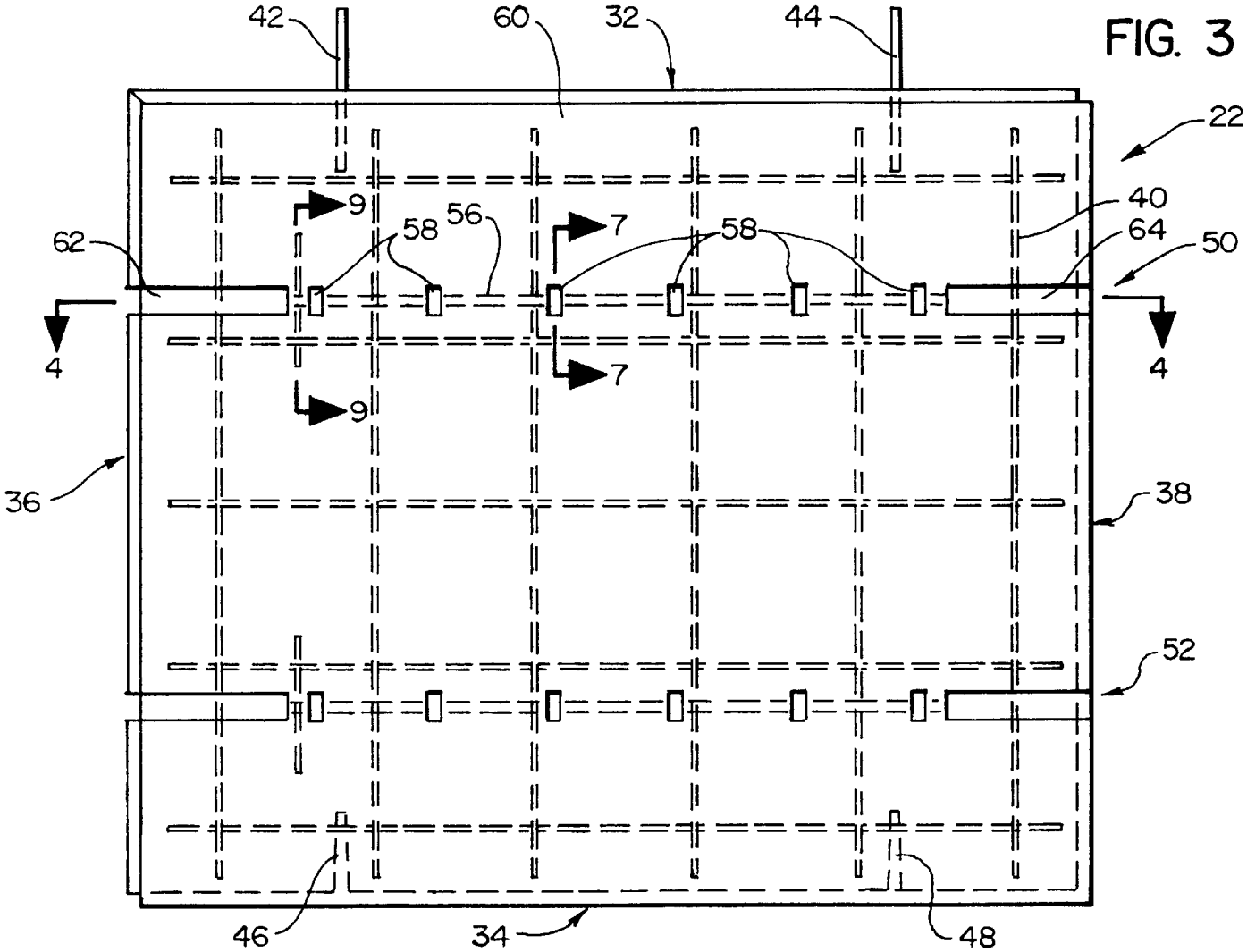
FIG. 3 is a rear elevation view depicting a single retaining wall section, with certain internal features of the retaining wall being depicted by broken lines.

Referring again to FIG. 1 and to FIG. 3, it can be seen that the full-height section 22 is a reinforced concrete member having an upper edge 32, a lower edge 34, a left side edge 36, and a right side edge 38. As is conventional, the section 22 is reinforced by a grid of reinforcement bar 40.

Optionally, alignment pins 42 and 44 and voids 46 and 48 may be cast into the section 22. The pins 42 and 44 extend from the upper edge 32 of the section 22, while the voids 46 and 48 are cast into the section 22 along its lower edge 34. The pins 42 and 44 and voids 46 and 48 allow the section 22 to be aligned with adjacent panels immediately above and below the panel 22. If the system includes the pints 42 and 44 and voids 46 and 48, the adjacent panels would comprise similarly located pins and voids.

The full-height section 22 further comprises first and second connecting void systems 50 and 52. The partial-height section 26 comprises only one connecting void system, which is identified by reference character 54 in FIG. 2. The connecting void systems 50–54 are identical and only the system 50 will be described herein in detail.

The connecting void system 50 comprises a pin void 56 that extends from the left side edge 36 to the right side edge 38. The system 50 further comprises a series of mesh voids 58 that open up to a rear surface 60 of the section 22. And finally, the system 50 comprises first and second pin windows 62 and 64. All of these voids 56, 58, 62, and 64 are formed by lubricated inserts that are cast into the section 22 and removed after the section 22 hardens. Preferably, these lubricated inserts are metal or plastic members that are greased and reused.

Figure 4:
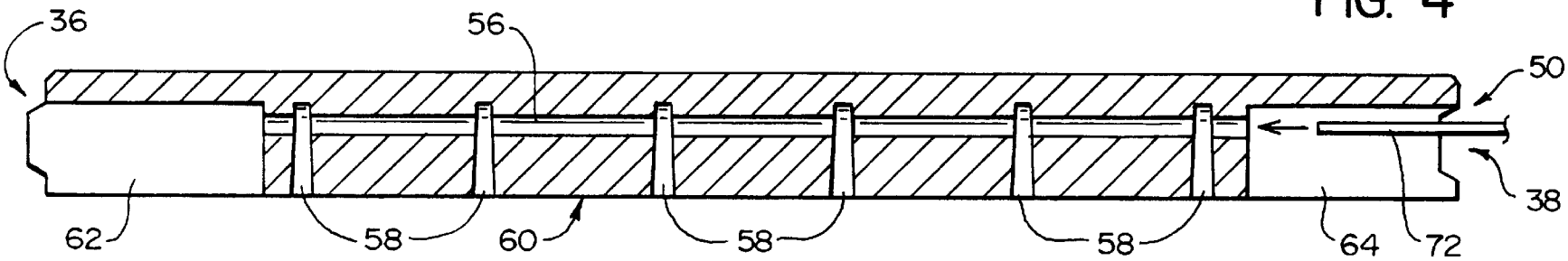
FIG. 4 is a top plan cut-away view taken along lines 4—4 in FIG. 3.

As shown and FIG. 4, the mesh voids 58 are spaced along the surface 60 such that they are in communication with the pin void 56. The pin windows 62 and 64 are formed adjacent to the left side edge 36 and right side edge 38, respectively, and are similarly in communication with pin void 56. The mesh voids 58 are symmetrically and evenly spaced along the rear surface 60 of the section 22.

Figure 1:
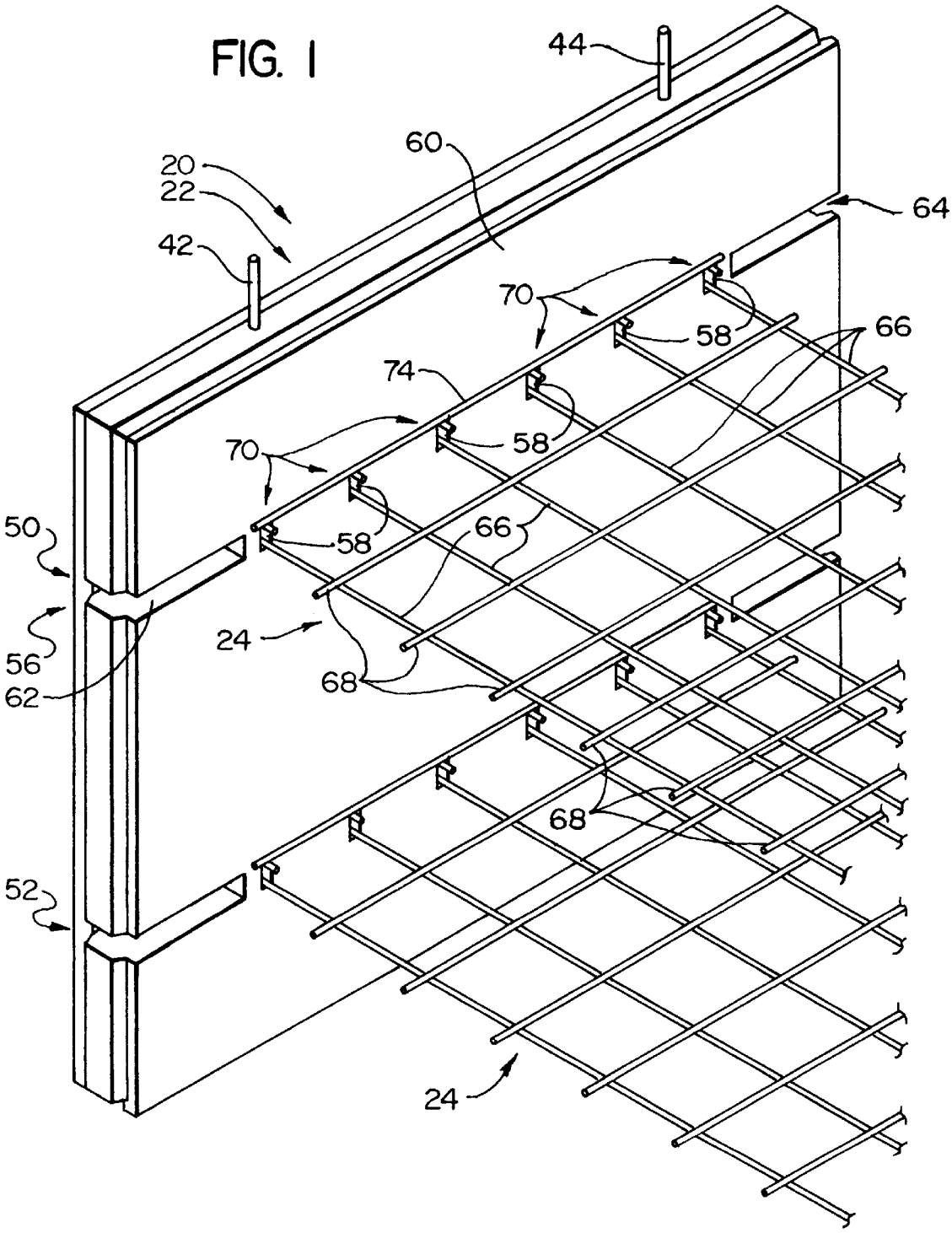
FIG. 1 is a perspective view of a retaining wall section and anchor mesh that are connected together to form a system in accordance with principles present invention.
Figure 5:
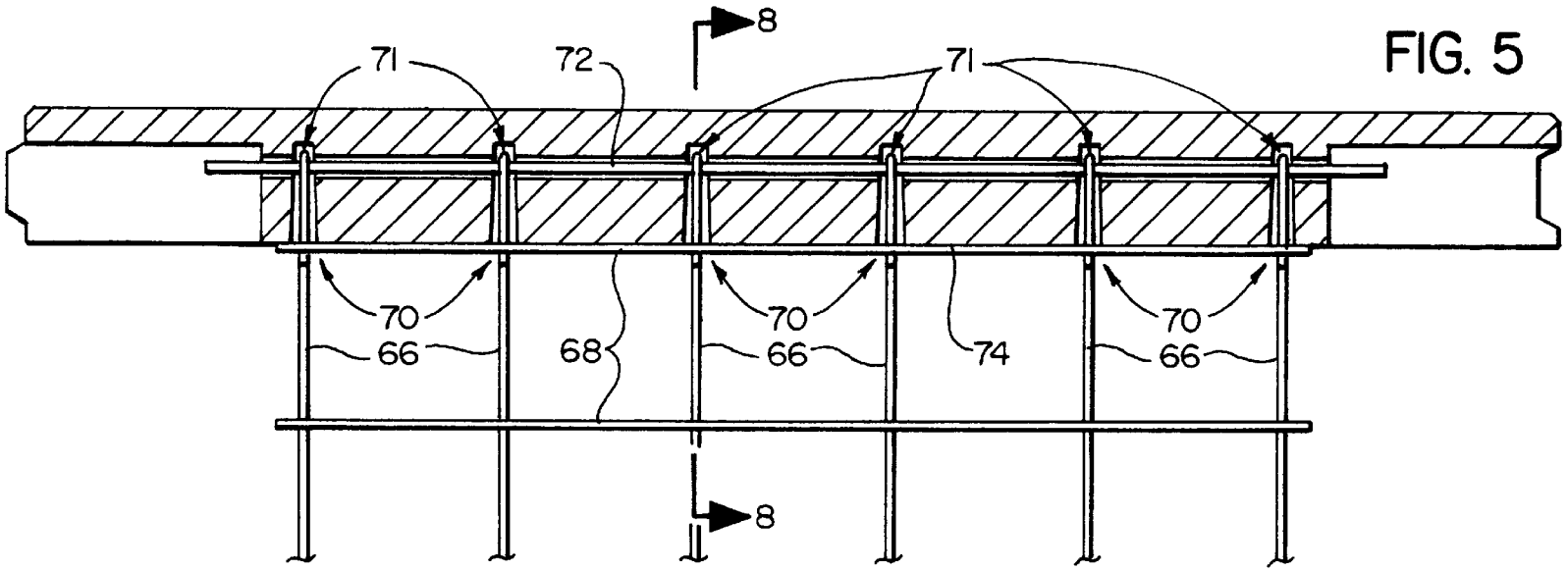
FIG. 5 is a top plan cut-away view depicting the connection between the anchor mesh and the retaining wall section depicted in FIG. 1.

FIGS. 1 and 5 show that the anchor mesh 24 comprises a first set of anchor bars 66 and a second set of transverse bars 68. As perhaps best shown in FIG. 8, proximal ends 70 of the anchor bars 66 are bent to form U-shaped loop portions 71.

Figure 7:
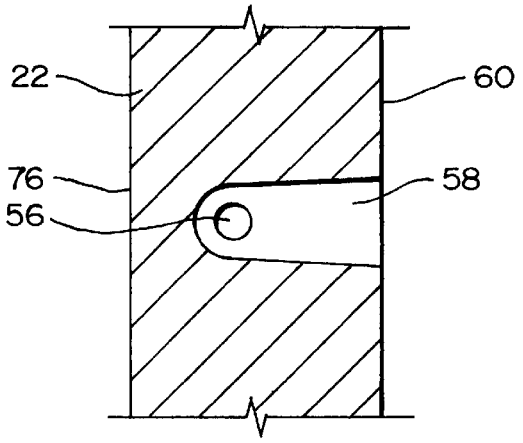
FIG. 7 is a side elevation cut-away view taken along lines 7—7 in FIG. 3.

As shown and FIGS. 1 and 7, the anchor mesh 24 is attached to be wall section 22 to form the system 20 by inserting the loop portions 71 of the anchor bar proximal ends 70 into the mesh voids 58. Then, as shown and FIGS. 4 and 5, a connecting pin 72 is inserted into the pin void 56 such that that it passes through the loop portions 71. The connecting pin 72 retains the proximal ends 70 within the mesh voids 58 such that loads on the rear surface 60 of the wall section 22 are transferred to the anchor bars 66 of the anchor mesh 24.

Figure 8:
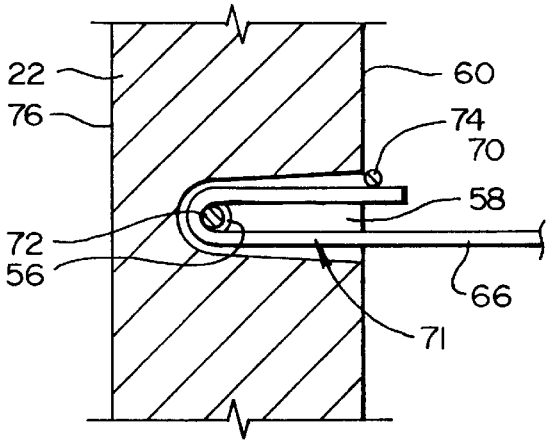
FIG. 8 is a side elevation cut-away view taken along lines 8—8 in FIG. 5.

To strengthen the connection between the anchor mesh 24 and the wall section 22, a anchor bearing bar 74 is secured to the loop portions 71 of the proximal ends 70 of the anchor bars 66. This anchor bearing bar 74 engages the rear surface 60 as shown in FIG. 8 to prevent movement of the proximal ends 70 towards a front surface 76 of the section 22.

The use of a anchor bearing bar 74 to prevent movement of the proximal ends 70 is important because, when earth is backfilled against the rear surface 60, very large loads will be transferred to the anchor bars 66; these loads are of sufficient magnitude that they can actually straighten out the loop portions 71 of the proximal ends 70. If this occurs, the connection between the wall section 22 and mesh 24 may fail. Because they prevent the loop portions 71 from straightening more that a controlled amount, the anchor bars 74 are thus an important aspect of the connection between the wall sections 22 and the anchor mesh 24.

The anchor bearing bar 74 further ensures that the anchor mesh 24 extends perpendicularly from the rear surface 60 of the section 22.

Figure 6:
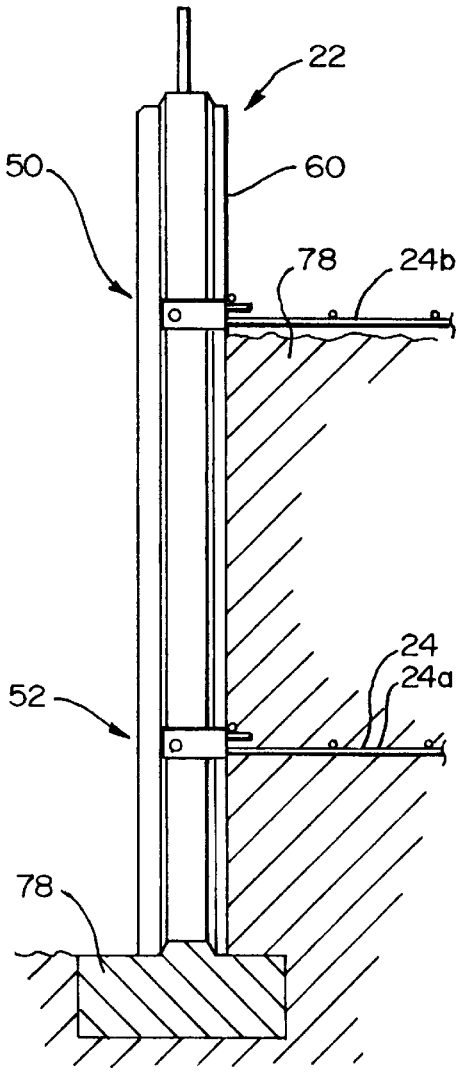
FIG. 6 is a side elevation view showing the system depicted in FIG. 1 being installed as part of a retaining wall.

The system 20 is installed as follows. Initially, a footer 78 as shown in FIG. 6 is poured at a desired location. A first course of alternating full-height and partial-height wall panels 22 and 26 is placed onto the footer (in FIG. 6, a full-height wall section 22 is shown). The proximal ends 70 of the anchor bars 66 of the lower anchor mesh 24*a* are first inserted into the mesh voids 58 of the lower connecting void system 52. The connecting pin 72 is inserted into the pin void 56 of the lower connecting void system 52 such that these proximal ends 70 are retained within the mesh voids 58.

A second layer of earthen material is placed level to the void system 50. The proximal ends 70 of the anchor bars 66 of the upper anchor mesh 24*b* are next inserted into the mesh voids 58 of the upper connecting void system 50. Another connecting pin 72 is inserted into the pin void 56 of the upper connecting void system 50.

Dirt indicated by reference character 78 is back-filled against the rear surface 60 of the section 22 around the anchor mesh 24*a* and 24*b* such that loads on the wall section 22 are transferred back into the dirt 78. Prior to the back-filling step, the distance between the anchor bearing bar 74 and a surface portion 79 of the loop portion 71 that engages the locking pin 72 will be sufficient to allow easy insertion of the locking pin 72. After the back-filling step, the loop portions 71 will tend to straighten slightly into the configuration shown in FIG. 8, reducing the distance between the anchor bearing bar 74 and the locking pin 72 and causing the entire connecting system 50 to tighten and securely connect the anchor mesh 24 to the panel 22.

Figure 10:
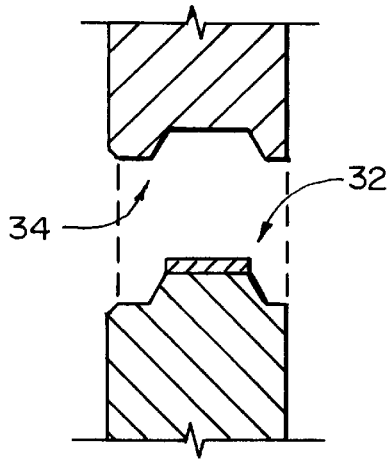
FIG. 10 is a side elevation view depicting how one retaining wall section engages another retaining wall section to form an retaining wall.

Usually, two or more courses of wall panels 22 will be formed to obtain a higher wall. In this case, once the first course of panels 22 and 26 is laid, at least one additional course of wall panels will be laid on top thereof. Accordingly, as shown in FIG. 10, for each additional course, the bottom edge 34 of the section 22 of each upper course is contoured to fit onto the upper edge 32 of the section 22 forming part of the lower course. If used, the alignment pins 42 and 44 and alignment voids 46 and 48 will ensure that adjacent courses are properly aligned and will help stabilize the wall while the anchor mesh is attached thereto as described above.

Figure 9:
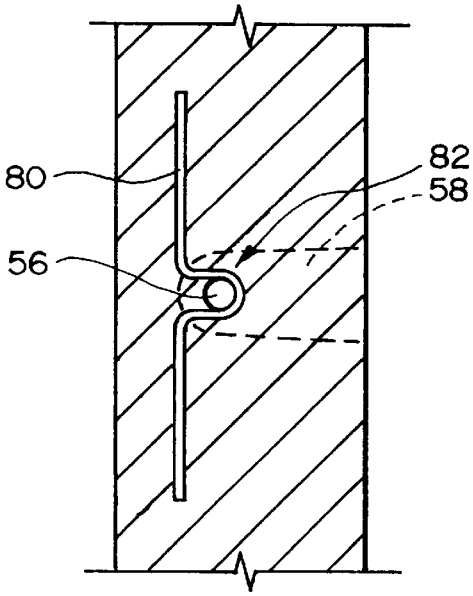
FIG. 9 is a side elevation cut-away view taken along lines 9—9 in FIG. 3.

FIG. 9 illustrates an additional detail of the wall panels 22. Embedded in the wall section 22 is a hairpin member 80. This hairpin member 80 is essentially a round bar but comprises a central portion 82 bent into a U-shape. This central portion 82 is aligned with the pin void 56 such that the connecting pin 72 passes through the central portion 82 after the pin 72 has been inserted through the proximal ends 70 of the anchor bars 66.

The hairpin member 80 reinforces the concrete wall section 22. Thus, if necessary, the connecting pin 72 can be configured such that it is locked into the pin void 56. This can be accomplished by forming a flange of some sort on a first end of the connecting pin; this flange is sized and dimensioned to fit within the pin windows 62 and 64 but such that it may not pass through the pin void 56. The second end of the connecting pin 72 is formed without such a flange and may be passed through the pin void 56. The second end is inserted through the pin void 56 such that the second end extends past the hairpin member 80. The second end may be bent out of the pin window 64, and the hairpin member 80 reinforces the section 22 where the pin 72 bears on the section 22. After the back-filling process, the connecting pin cannot be inadvertently removed from the pin void 56.

The system 20 thus serves to anchor the wall panels 22 to the fill earth 78 so that the wall formed thereby remains upright. The system 20 is easy and inexpensive to manufacture and install.

Figure 11:
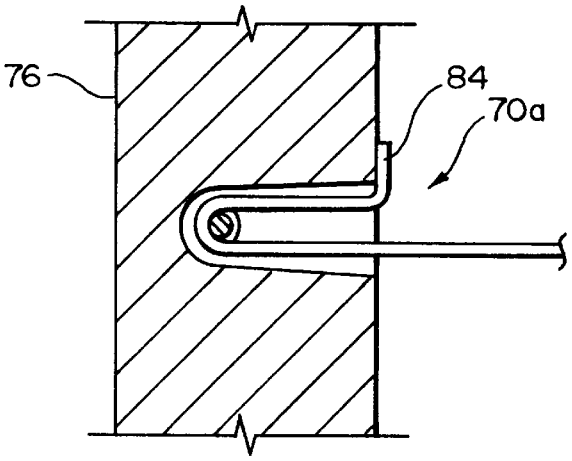
FIG. 11 is a side elevation view depicting an alternate configuration of the anchor mesh that may be used as part of the present invention.
Figure 12:
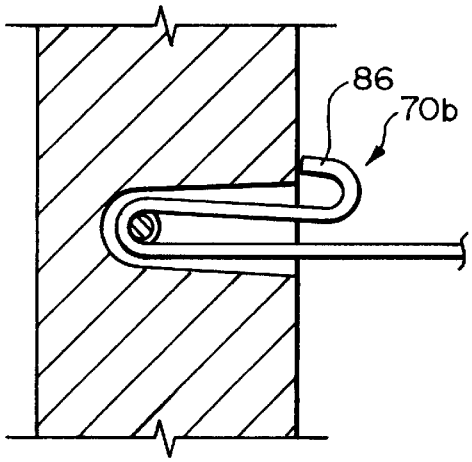
FIG. 12 is a side elevation view depicting yet another alternate configuration of the anchor mesh that may be used as part of the present invention.

FIGS. 11 and 12 depict first and second alternate proximal ends 70*a* and 70*b* that may be formed on the anchor bars 66. The end 70*a* comprises, in addition to a U-shaped portion, a vertical portion 84 that may be used in conjunction with the anchor bearing bar 74 to keep the proximal end 70*a* from moving too far towards the front surface 76. The end 70*b* comprises a second smaller U-shaped portion 86 formed on the main U-shaped portion. This unshaped portion 86 may also be used in conjunction with an anchor bearing bar 74 to keep the proximal end 70*b* tight against the surface of the concrete panel. In some situations, the vertical portion 84 and unshaped portion 86 may, as shown, obviate the need for a anchor bearing bar such as the bar 74 described above.

Figure 13:
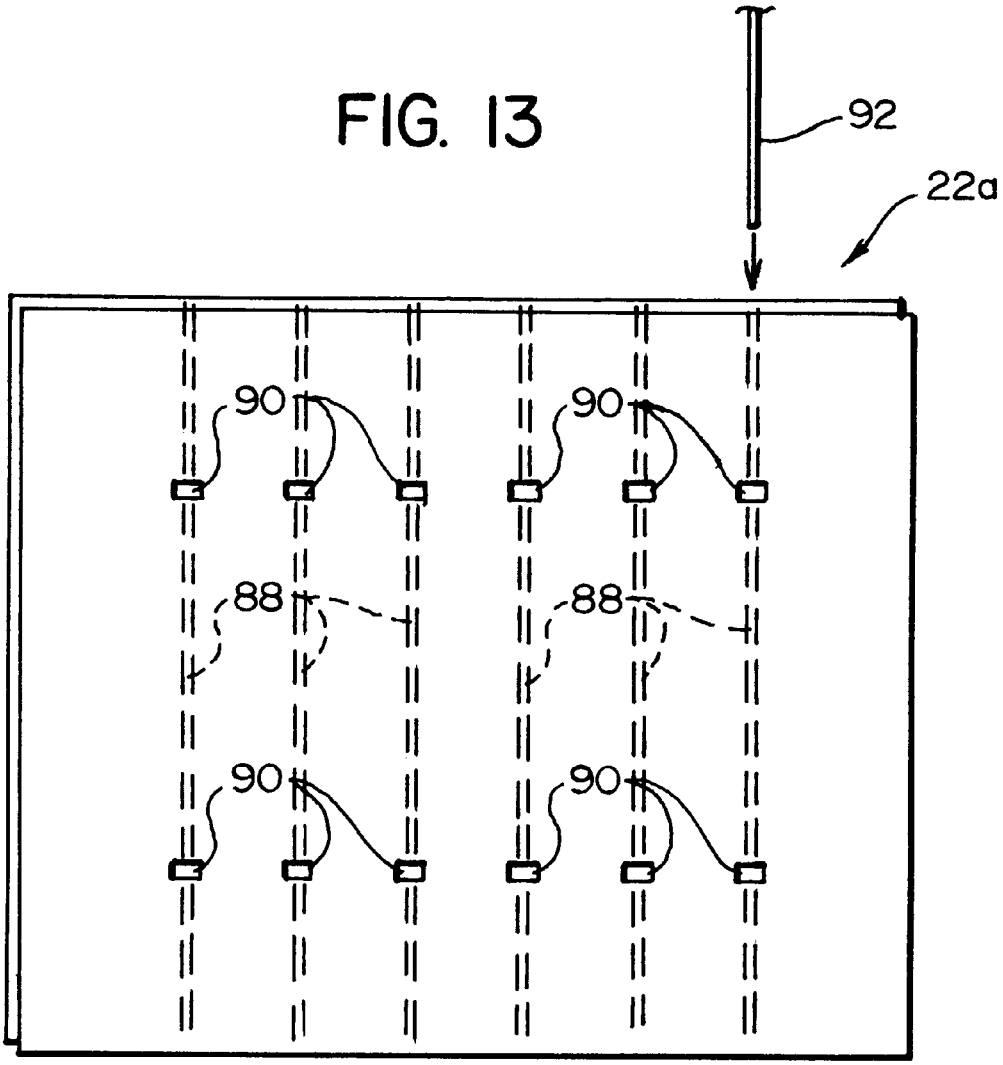
FIG. 13 is a front elevational view depicting another exemplary embodiment of the present invention in which the connecting pins are inserted from the top.

And as shown in FIG. 13, the directions of the pin voids may be switched so that they are vertically aligned. Shown in FIG. 13 is a wall section 22*a* having six vertically aligned pin voids 88. These voids 88 pass through mesh voids 90. The voids 88 and 90 are both aligned so that connecting pins 92 extend through proximal ends of a mesh from the top. This particular embodiment requires more connecting pins but may be preferable in situations where access to the tops of the wall panels is easier than access to the sides thereof.

Figure 14:
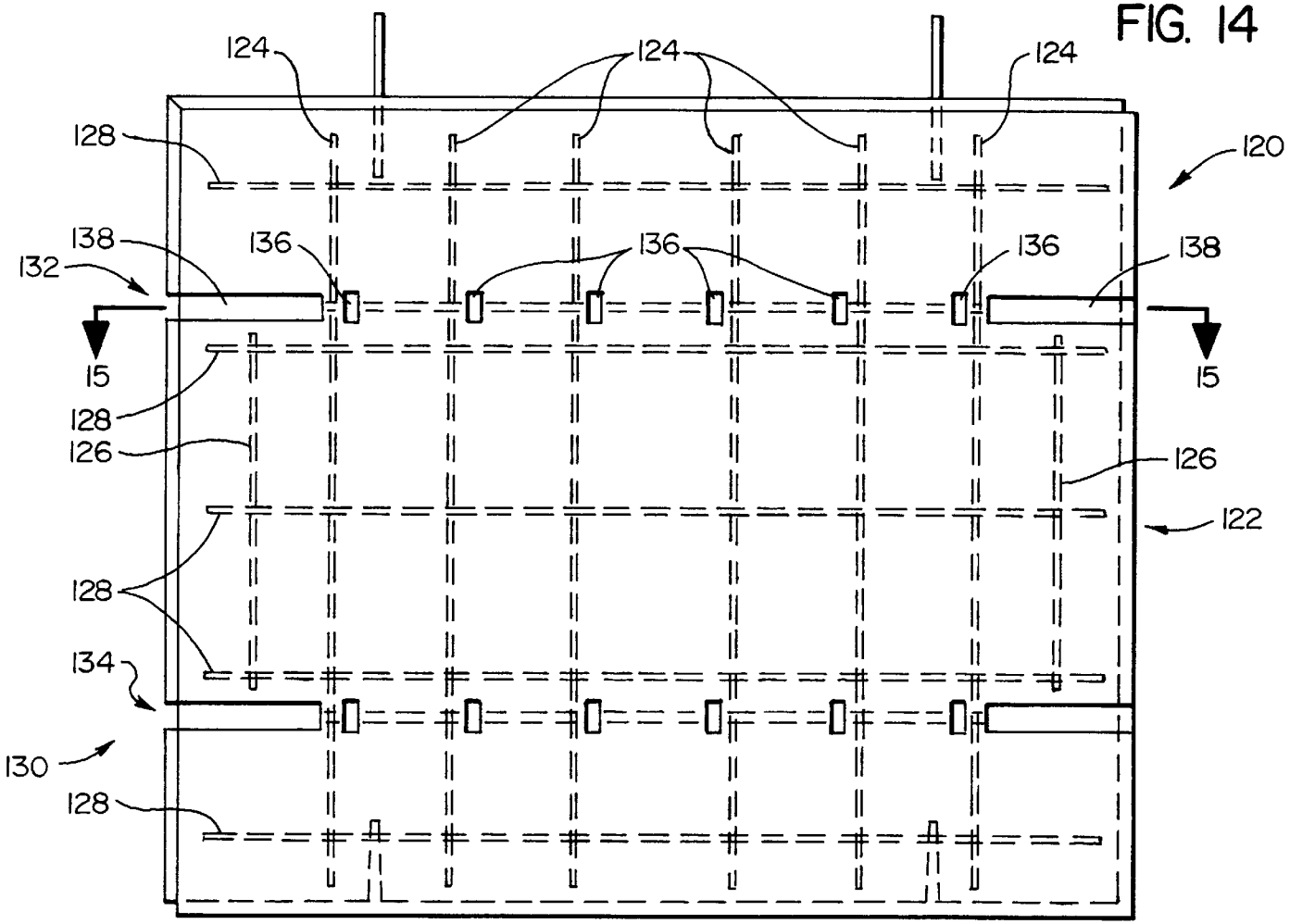
FIG. 14 is a rear elevation view depicting a another exemplary retaining wall section of the present invention, with certain internal features of the retaining wall being depicted by broken lines.
Figure 15:
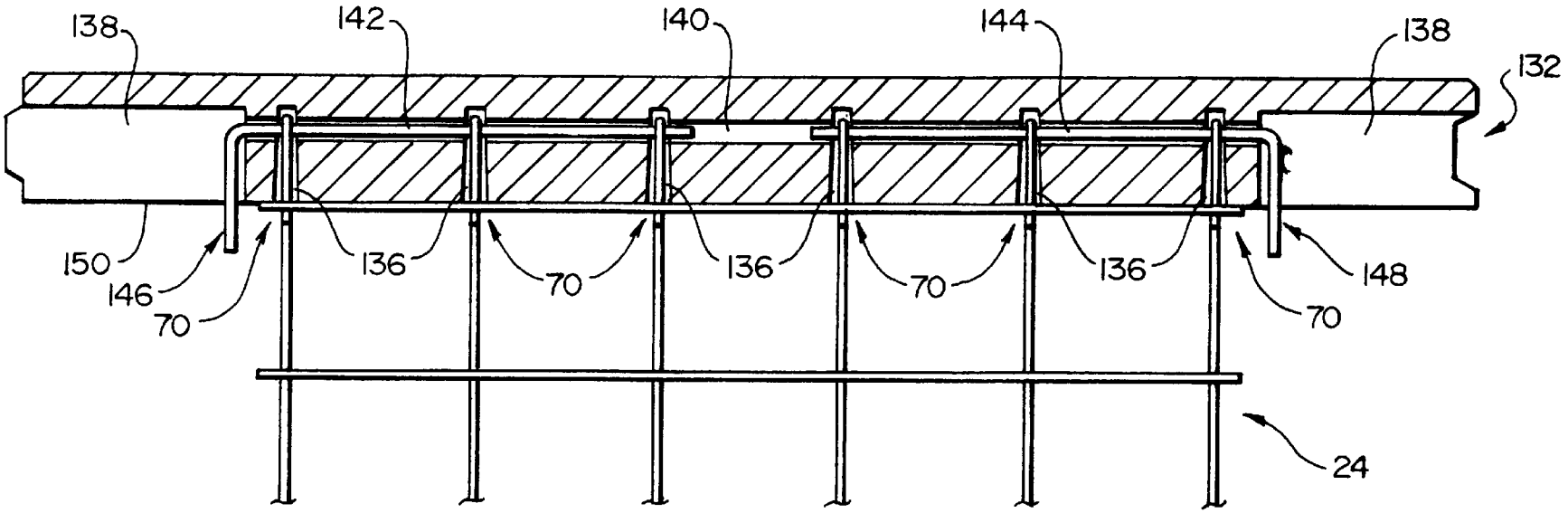
FIG. 15 is a top plan cut-away view taken along lines 15—15 in FIG. 14.

Referring now to FIGS. 14 and 15, depicted therein at reference character 120 is yet another exemplary retaining wall panel constructed in accordance with the present invention. This panel 120 is a precast reinforced concrete member similar to the panel 22 described above. The panel 120 will be described herein only to the extent necessary to explain the differences in construction and installation from the panel 20.

The panel 120 comprises an array of reinforcing bars 122 comprising six long vertical reinforcing bars 124, two short vertical reinforcing bars 126, and five horizontal reinforcing bars 128. The panel further comprises a connecting system 130 comprising upper and lower void networks 132 and 134. These void networks 132 and 134 are identical and only one will be described in detail herein.

As perhaps best shown in FIG. 15, the void network 132 comprises six mesh voids 136, two pin windows 138, and a pin void 140. The array 122 of reinforcing bar is configured such that the long vertical bars 124 are spaced between the pin windows 138 and the mesh voids 136. The short vertical bars 126 are arranged between the vertically adjacent pin windows 138 of the void networks 132 and 134. The horizontal bars 128 are evenly spaced such that they are not vertically even with or closely adjacent to the void networks. This arrangement of reinforcing bar adds structural rigidity to the panel 120 while not interfering with the formation or use of the void networks 132 and 134.

Referring for a moment back to FIG. 15, it can be seen that the mesh section 24 is connected to the panel 120 by using two pins 142 and 144 rather than a single pin as with the panel 22 described above. These two pins 142 and 144 each have an end that is bent, as shown at 146 and 148, such that the pins 142 and 144 are generally L-shaped.

To connect the panel 120 to the mesh section 24, the pins 142 and 144 are inserted through opposite ends of the pin void 140 such that each pin 142 and 144 extends through three of the looped ends 70 of the mesh section 24. As shown in FIG. 15, when the pins 142 and 144 are completely inserted into the pin void 140, the bent ends 146 and 148 reside in the pin windows 138 and extend rearwardly in line with the mesh section 24. The total length of the two pins 142 and 144 is slightly shorter than the length of the pin void 140.

The use of two pins 142 and 144 with bent ends 146 and 148 obtains the following benefits. Initially, the pin windows 138 are slightly longer than half the length of one of the pins 142 and 144. The pins 142 and 144 themselves are each long enough to extend through half (three, in this case) of the loop portions 71 defined by the anchor mesh 24.

Accordingly, when two pin windows are aligned as shown in FIG. 2, the pins 142 and 144 may be displaced laterally until they are entirely within the two adjacent pin windows and then displaced along their axes towards each other into the pin void 140 to the positions shown in FIG. 15. In this position, each pin extends through three loop portions, but does not need to be angled to allow insertion. This greatly simplifies the process of inserting the locking pins into the pin voids and thus reduces the overall costs of building the retaining wall system 20.

The bent ends 146 and 148 of the pins 142 and 144 may be easily grasped to facilitate insertion of the pins 142 and 144. And once dirt is backfilled against a rear surface 150 of the panel 120, this dirt will fill the pin windows 138, engage the bent ends 146 and 148, and thus prevent movement of the pins 142 and 144 out of the pin void 140.

II. Retaining Wall System Employing Wire Wall Panels

Figure 16:
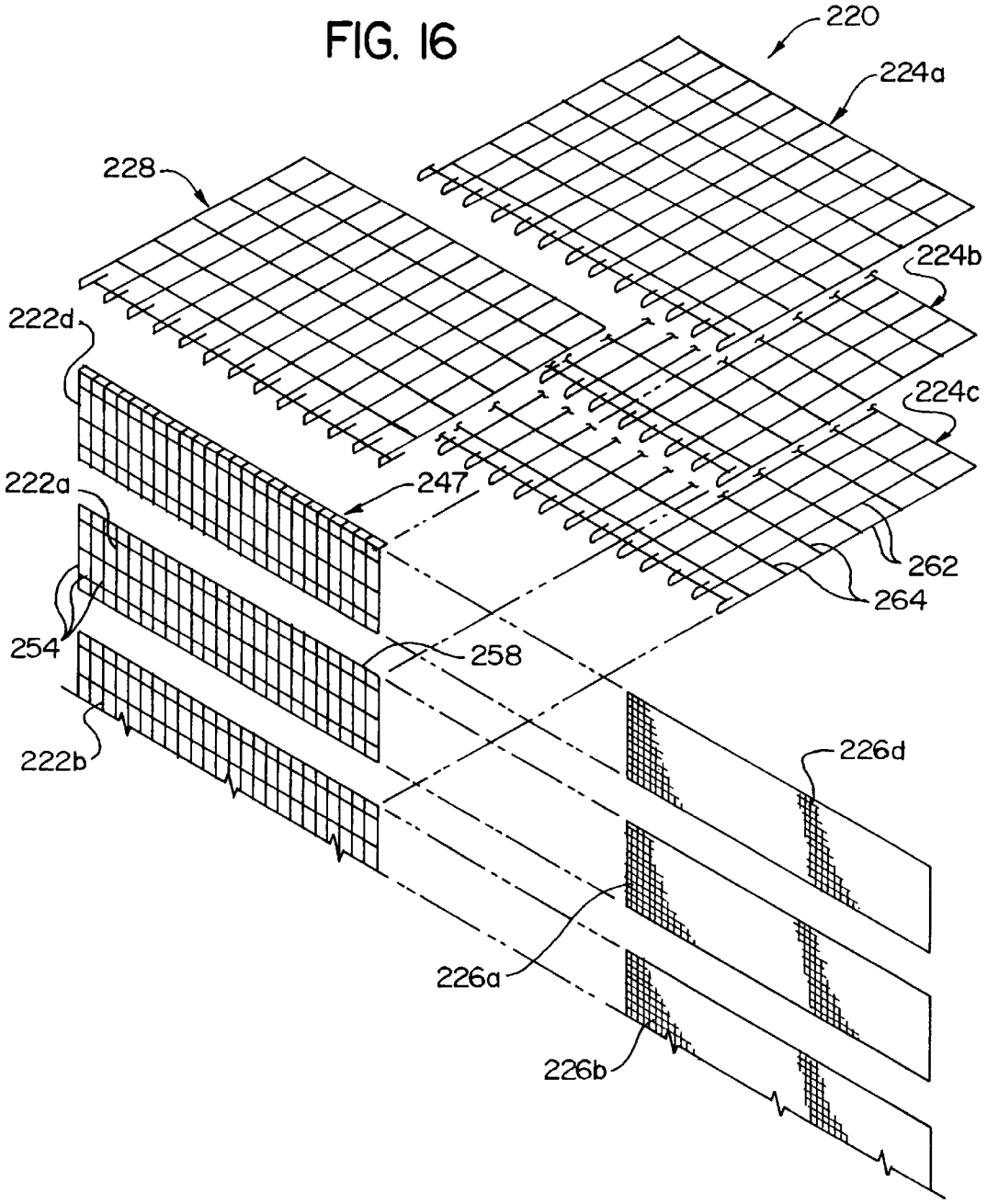
FIG. 16 is an exploded perspective view showing major components of a second embodiment of a retaining wall system of the present invention.
Figure 17:
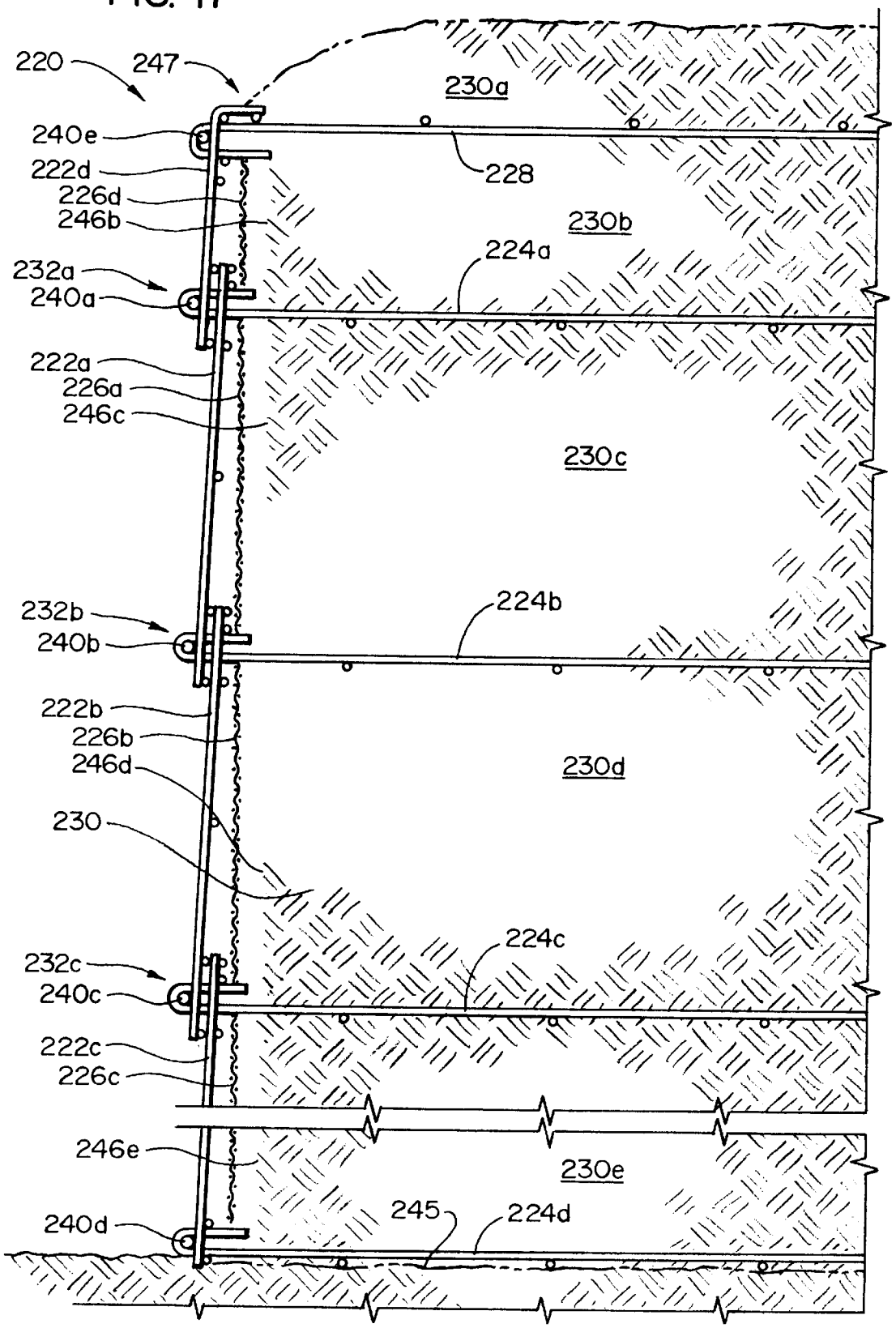
FIG. 17 is a side, elevation, section view of the retaining wall system of FIG. 16 shown stabilizing an earthen wall.

Referring now to FIGS. 16–20, depicted at 220 in FIG. 16 is a second embodiment of a retaining wall system constructed in accordance with the principles of the present invention. The system 220 employs wire wall panels 222*a–d*, buried anchor mesh 224*a–d*, construction fabric 226*a–d*, and top anchor mesh 228. In FIG. 17, the system 220 is shown reinforcing an earthen wall 230.

The panels 222 are connected to the anchor mesh 224 by connecting systems 232*a–c*. These connecting systems are substantially the same in the exemplary system 220, so only the connecting system 232*b* will be described in detail herein, with the understanding that this description applies to the other connecting systems.

The connecting system 232*b* comprise a lower edge 234 of the wall panel 222*a*, an upper edge 236 of the wall panel 222*b*, a proximal edge 238 of the anchor mesh 224*b*, a locking pin 240, and a anchor bearing bar 242. As perhaps best shown in FIG. 18, the locking pin 240 is inserted into a loop portion 244 of the anchor mesh proximal end 238 such that the wall panel edges 234 and 236 are spaced between the locking pin 240 and the earthen wall 230. As shown in FIGS. 16 and 17, one locking pin 240 is provided for each of the connecting systems 232, with the suffix "a" being added to the reference character 240 to correspond to the appropriate connecting system.

Figure 18:
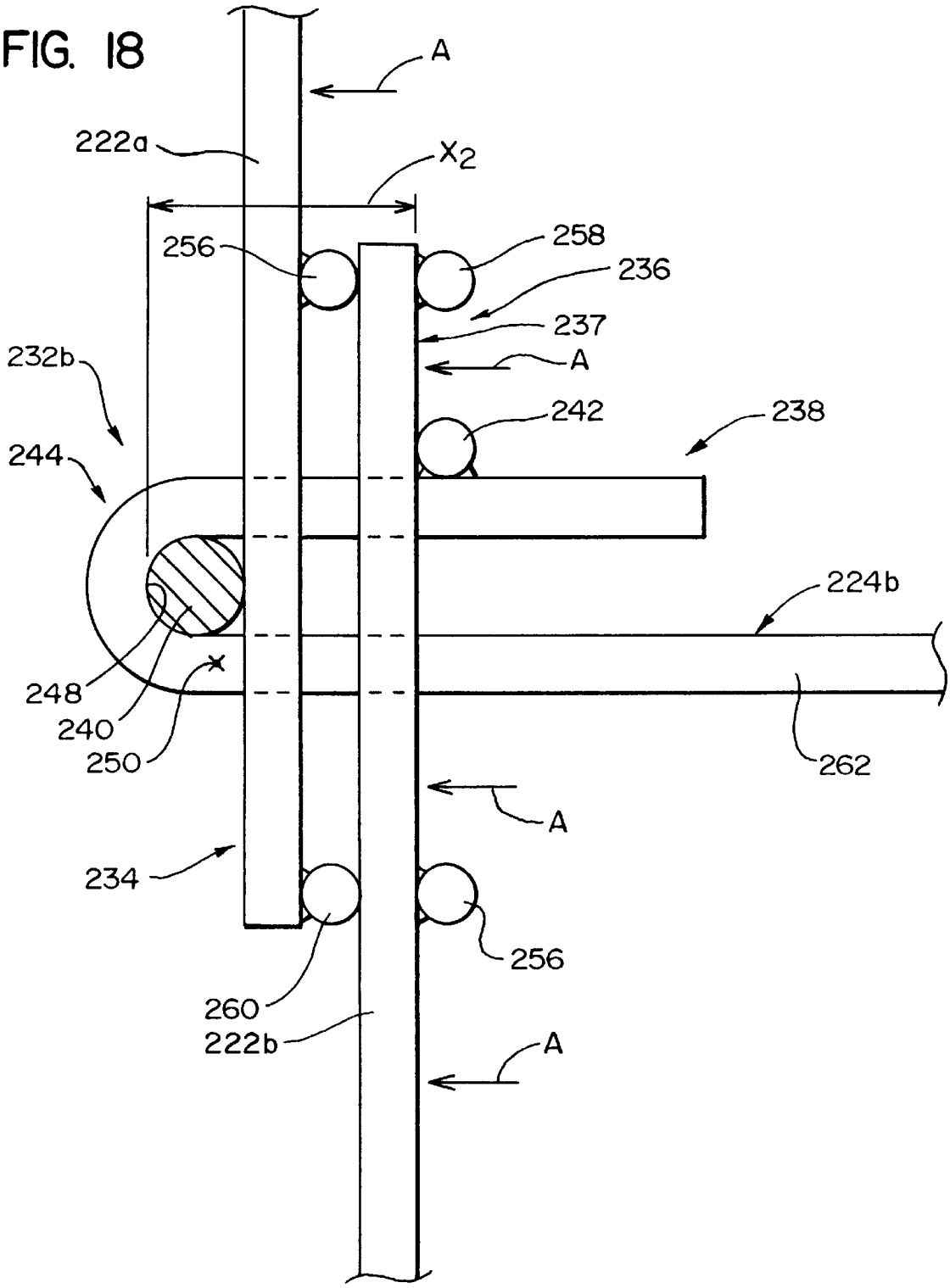
FIG. 18 depicts a connecting assembly employed by the retaining wall system of FIG. 16.

When inserted into the loop portion 244, the locking pin 240 directly engages the proximal edge 238 of the anchor mesh 224*b*, directly engages the lower edge 234 of the wall panel 222*a*, and indirectly engages the upper edge 236 of the wall panel 222*b* to prevent the wall panel edges 234 and 236 from moving substantially in the direction shown by arrows A in FIG. 18 relative to the anchor mesh 224*b*.

The anchor bearing bar 242 is welded to the anchor mesh 224*b* such that, when the system 232 is assembled, the anchor bearing bar 242 directly engages a back surface 237 of the upper edge 236 of the wall panel 222*b* to prevent the proximal edge 238 of the anchor mesh 224*b* from moving substantially relative to the wall panels 222*a* and 222*b*.

Figure 19:
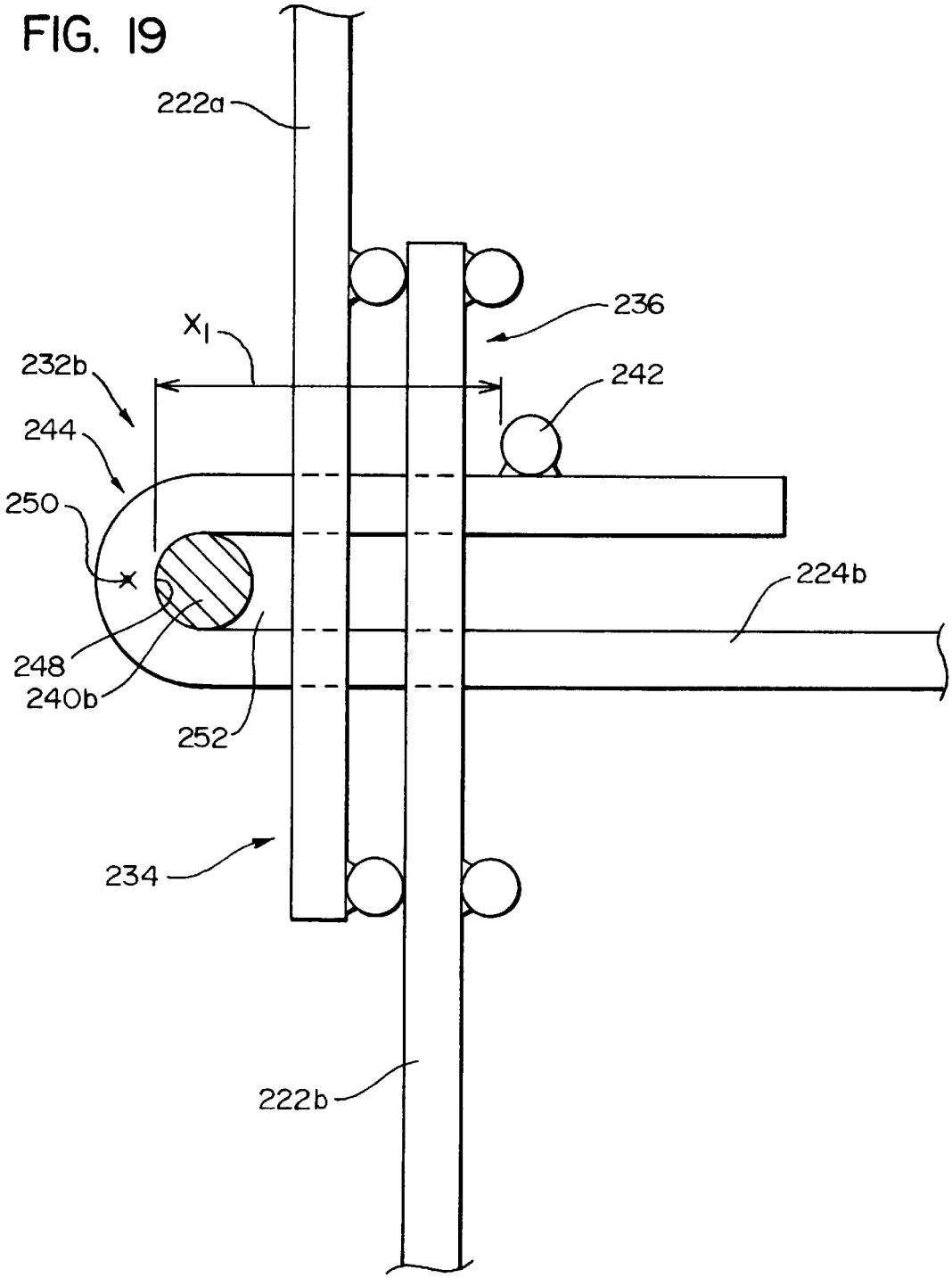
FIG. 19 depicts the connecting assembly of FIG. 18 before earth is backfilled against the wall panels.
Figure 20:
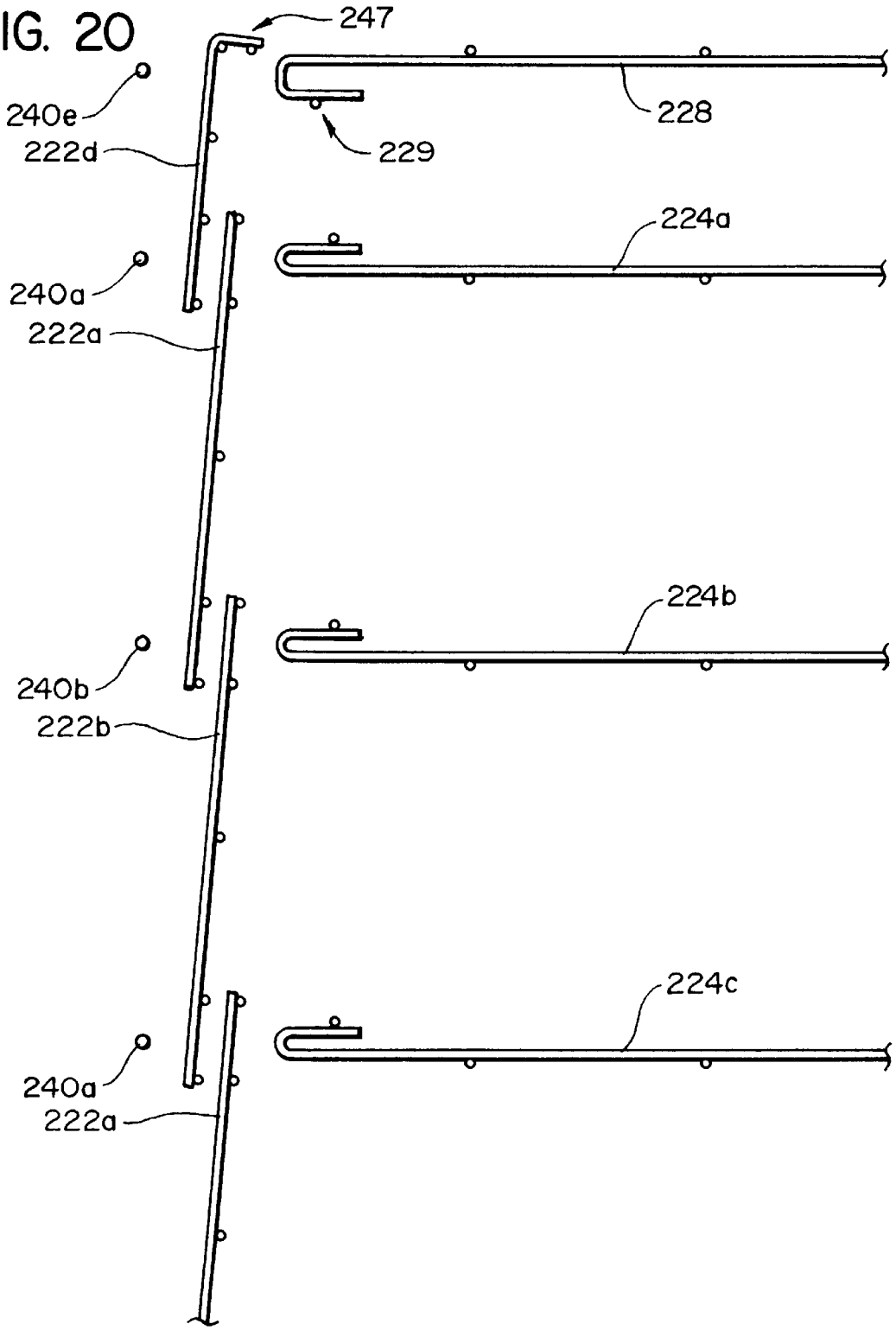
FIG. 20 depicts a side, elevational view of the retaining wall system of FIG. 16 slightly exploded to show the assembly process.

The process of assembling the retaining wall system 220 is shown in FIGS. 18,19, and 20. FIG. 20 depicts an exploded view of the system 220 prior to assembly.

In general, the system 220 is assembled from the bottom towards the top. And as shown in FIG. 20, the wall panels 222 are arranged in a ship lap configuration in which the lower edge of one panel overlaps the upper edge of the panel immediately therebelow.

The construction fabric 226 located between the earthen wall 230 and the wall panels 222 is schematically depicted in FIG. 17 for purposes of clarity. In particular, the construction fabric 226 is thinner than actually shown. And, when the wall system 220 is fully formed, the earthen wall 230 will force the construction fabric 226 against the wall panels 222; this is not depicted in FIG. 17 so that the assembly of the wall panels 222 to the anchor mesh 224 can be clearly seen.

The assembly of the system 220 will now be described with reference to FIG. 17. Initially, the anchor mesh 224*d* is laid on grade, which is indicated by reference character 245 in FIG. 17. The front panel 222*c* is placed in front of the location where the earthen wall 230 is to be formed, and the construction fabric 226*c* is attached to the panel 222*c*.

The wall panel 222*c* is then connected to the anchor mesh 224*d* by a locking pin 240*d*. The connection formed between the front panel 222*c* and the anchor mesh 224*d* is similar to what is described above, except that the anchor mesh extends through only one wall panel because the ship lap arrangement does not start until the second course of wall panels.

After the connection between the panel 222*c* and anchor mesh 224*d* is formed, at least a part of the first layer of earth 230*e* is formed on top of the anchor mesh 224*d*. At this point, the anchor mesh 224*c* is laid on the first layer 230*e* so that the mesh 224*c* is generally horizontal. The front panel 222*c* is then rotated upwardly until the anchor mesh 224*c* extends through the front panel 222*c*. The next front panel 222*b* is then arranged such that the anchor mesh 224*c* passes through a lower end thereof to form the ship lap arrangement between the front panel 222*b* and the front panel 222*c*. Another locking pin 240*c* is then inserted to form the connection between the panels 222*b* and 222*c* and anchor mesh 224*c*.

Dirt is then backfilled against the wall panel 222*c* to complete the formation of the first layer 230*e*. In particular, the dirt passes through the anchor mesh 224*c* to complete the formation of the first layer 230*e*. The construction fabric 226*c* has been previously attached to the wall panel 222*c*, so after the formation of the first layer 230*e* is completed, the construction fabric 226*c* lies between the wall panel 222*c* and a face portion 246*e* of the earthen layer 230*e*.

At this point, additional dirt is backfilled on top of the first earthen layer 230*e* to form part of the second earthen layer 230*d*. The anchor mesh 224*b* is placed on top of the partially formed second layer 230*d* such that the mesh 224*b* is substantially horizontal and its end extends through the upper portion of the wall panel 222*b*.

The sheet of construction fabric 226*b* is next attached to the wall panel 222*b*. The wall panel 222*b* is then arranged such that its lower end overlaps the upper end of the wall panel 222*b* and the anchor mesh 224*b* extends therethrough. Another locking pin 240*b* is then inserted to complete the connection between the wall panels 222*b* and 222*a* and the anchor mesh 224*b*.

Dirt is then backfilled against the wall panel 222*b* through the mesh 224*b* to complete the formation of the second earthen layer 230*d*. When the second earthen layer 230*d* is formed, the construction fabric 226*b* attached to the wall panel 222*b* is now arranged between the panel 222*b* and a face portion 246*d* of the earthen layer 230*d*. Then enough dirt is backfilled on top of the second earthen layer 230*d* to form at least a portion of the third earthen layer 230*c*.

This process is repeated until the retaining wall 230 reaches close to its final height. In the exemplary system 220, the third earthen layer 230*c* is close to the final height of the earthen wall 230, so the process of finishing off the top of the wall 230 begins after at least a part of the third earthen layer 230*c* is formed.

In particular, the anchor mesh 224*a* is placed on top of the partially formed third earthen layer 230*c* such that the mesh 224*a* extends through an upper portion of the wall panel 222*a*. The construction fabric 226*a* is then attached to the wall panel 222*a*. The wall panel 222*d* is displaced such that the anchor mesh 224*a* extends through a lower portion of the panel 222*d*, and a locking pin 240*a* is inserted through the loop portion of the anchor mesh 224*a*. This forms a connection as described above between the anchor mesh 224*a* and the wall panels 222*a* and 222*d*.

Dirt is then backfilled through the anchor mesh 224*a* against the construction fabric 226*a* and the wall panel 222*a* to complete the formation of the third earthen layer 230*c*. The construction fabric 226*a* is previously attached to the wall panel 222*a* is arranged between the wall panel 222*a* and a face portion 246*c* of the third earthen layer 230*c*. Additional dirt is then backfilled on top of the third earthen layer 230*c* to form at least part of the fourth earthen layer 230*b*.

The wire wall panel 222*d* is similar to the other wall panels 222 except that an upper portion 247 thereof is bent at approximately ninety degrees. Before the panel 222*d* is connected to the anchor mesh 224*a*, the construction fabric 226*d* is attached to the back side of the wall panel 222*d* underneath the bent upper portion 247.

The top anchor mesh 228 is then placed onto the partially formed fourth earthen layer 230*b*. So arranged, the top anchor mesh 228 is generally horizontal and extends through the wall panel 222*d* with the bent over top portion 247 of the wall panel 222*d* resting on top of the top anchor mesh 228. The locking pin 240*e* is then inserted through the loop portion of the top anchor mesh 228 to connect the top anchor mesh 228 to the uppermost wall panel 222*d*.

Dirt is then backfilled through the top anchor mesh 228 to complete he formation of the fourth earthen layer 230*b*. At this point, the construction fabric 226*d* attached to the wall panel 222*d* is arranged between a face portion 246*b* of the fourth earthen layer and the wall panel 222*d*. A top or cover earthen layer 230*a* is then formed such that almost the entire top anchor mesh 228 is covered.

A comparison of FIGS. 18 and 19 illustrates in further detail the manner in which the connection is formed between the wall panels 222 and the anchor mesh 224 where the panels 222 overlap. FIG. 19 shows the relationship of the panels 222*a* and 222*b* and the anchor mesh 224*b* before earth is backfilled against the retaining wall system 220 to form the earthen layer 230*e*.

As illustrated by a comparison of FIGS. 18 and 19, a distance X between the anchor bearing bar 242 and an inner surface 248 defining the closed end of the loop portion 244 is longer in FIG. 19 than in FIG. 18. This distance is labeled X1 in FIG. 19 and X2 in FIG. 20, with X2 being slightly shorter than X1.

The shortening of this distance X occurs because, as earth is backfilled against the wall panels 222*a* and 222*b* to form the layer 230*c*, forces are applied to these panels 222*a* and 222*b* in the direction shown by arrows A in FIG. 18. These forces tend to straighten the anchor mesh proximal edge 238 such that a portion of the proximal edge 238 identified by reference character 250 moves from a first location shown in FIG. 19 to a second location shown in FIG. 18.

The movement introduced by these forces initially causes the anchor bearing bar 242 to contact the upper edge 236 of the panel 222*b*. Further movement causes the locking pin 240 to come into contact with the lower edge 234 of the panel 222*a*. When this occurs, the connecting system 232*b* becomes static because the locking pin 240 contacts the back surface of the 237 of the wall panel 222*b* and prevents further straightening of the proximal edge 238.

Referring more specifically to FIG. 19, it can be seen therein that, before the movement described above with reference to FIG. 18, the locking pin 240 may be easily inserted into a space 252 defined by the loop portion 244. After the movement described with reference to FIG. 18, the various components that form the connecting system 232*b* engage each other to prevent relative movement between these components. In particular, friction will prevent the locking pin 240 from being easily removed from the space 252 after the connecting system 232*b* has moved into the static configuration shown in FIG. 18.

The system 220 is thus engineered to provide sufficient slack to allow the connecting assemblies 232 to be formed but also to ensure that this slack is taken up when the back fill material acts on the retaining wall. And the amount of movement allowed by the connecting assemblies 232 is controlled such that the system 220 is stable after this movement occurs.

The wall panels 222, anchor mesh 224, construction fabric 226, top panel 228, and locking pin 240 of the system 220 will now be described in further detail.

As shown in FIG. 16, the wall panels 222 comprise a plurality of steel rods welded together to form a rigid or semi-rigid rectangular array. In particular, each of the exemplary panels 222 comprises a plurality of vertical bars 254, a plurality of middle horizontal bars 256, an upper horizontal bar 258, and a lower horizontal bar 260.

The exemplary vertical bars 254 are arranged at evenly spaced intervals along the width of the panel 222. The middle horizontal bars 256 are evenly spaced between the top and bottom of the panel 222. The upper and lower horizontal bars 258 and 260 are attached at the upper ends and lower ends, respectively, of the vertical bars 254. The top panel 222*d* is similar to the panels 222 but is, as briefly described above, bent at a right angle as indicated at 247.

The anchor mesh 224 comprises a plurality of anchor bars 262 and a plurality of transverse bars 264. These bars 262 and 264 are welded together to form a rigid or semi-rigid rectangular array.

The proximal edge 238 and loop portions 244 of the anchor mesh 224 are formed by ends of the anchor bars 262. In particular, the anchor bars 262 are bent approximately 180° such that they form a "j" shape. The anchor bearing bar 242 is welded to the loop portions 244 of the anchor bars 262 at a location that is designed to allow the controlled straightening of the anchor bars 262 as generally described above.

The locking pins 240 are steel bars that are designed to transfer loads on the anchor bars 262 to the panels 222 without failing.

The bars from which the wall panels 222, anchor mesh 224, top panel 228, and locking pin 240 are fabricated may be unfinished, painted, or galvanized, depending upon whether the retaining wall formed therewith is to be temporary or permanent.

The following Table A describes certain preferred parameters of the present invention as well as acceptable alternatives thereto.

TABLE A

| PARAMETER | PREFERRED | FIRST ALTERNATIVE |
|---|---|---|
| vertical bar diameter | 0.319" | 0.329" |
| horizontal bar diameter | 0.319" | 0.329" |
| anchor bar diameter | 0.374"–0.553" | — |
| transverse bar diameter | 0.374" | — |
| construction fabric | 24 ga. | — |
| locking pin | 0.618" | 0.628" |
| anchor bar | 0.374" | — |
| distance X1 | 1.825" | 1.865" |
| distance X2 | 1.575" | 1.615" |

One of ordinary skill in the art will recognize that the present invention may be embodied in forms other than those described above and still practice the present invention. The scope of the present invention should thus be determined by reference to the following claims rather than the foregoing detailed description.

I claim:

1. A retaining wall system for stabilizing an earthen wall, comprising:

at least one wall panel for engaging a face of the earthen wall;

anchor mesh buried within the earthen wall, the anchor mesh comprising an anchor bearing bar and a plurality of anchor bars each having proximal end, where the anchor bars are bent to define a loop portion and the anchor bearing bar is rigidly attached to the anchor bars between the loop portions and the proximal ends of the anchor bars; and a locking pin inserted into the loop portion of the anchor mesh;

the anchor mesh being arranged to extend through a void in the wall panel such that the locking pin engages the loop portion of the anchor mesh and at least a portion of the wall panel is located between the locking pin and the anchor bearing bar;

the anchor bearing bar being attached to the anchor bars such that the anchor bearing bar is initially spaced from a back surface on the wall panel a predetermined distance where the predetermined distance is predetermined to facilitate assembly of the retaining wall system and, when loads are applied on the wall panel, the loop portion of the anchor mesh deforms to allow the anchor bearing bar to engage the back surface of the wall panel to maintain a position of the wall panel relative to the anchor mesh and thereby stabilize at least a portion of the earthen wall.

2. A system as recited in claim 1, in which the anchor bearing bar is attached to the anchor bar such that a distance between the anchor bearing bar and a portion of the anchor bars that engages the locking pin is predetermined to allow the locking pin to be inserted through the loop portions during assembly of the retaining wall system and to decrease by a controlled amount due to forces introduced on the wall panels during the process of creating the earthen wall.

3. A system as recited in claim 1, in which:

the wall panel is a concrete member having a connecting void network formed therein; and the loop portion of the anchor mesh and the locking pin extend at least partly into the connecting void network.

4. A system as recited in claim 3, in which the connecting void network comprises:

a plurality of mesh voids; and a pin void in communication with the mesh voids, wherein the locking pin extends through the pin void and the mesh voids.

5. A system as recited in claim 3, in which:

the locking pin comprises first and second locking pin sections; and the connecting void network comprises first and second pin windows; wherein the pin windows of adjacent wall panels align to allow the first locking pin section to be inserted into the pin void through the first pin window and the second locking pin section to be inserted into the pin void through the second pin window.

6. A system as recited in claim 4, in which:

the locking pin comprises first and second locking pin sections; and the connecting void network further comprises first and second pin windows; wherein the pin windows of adjacent wall panels align to allow the first locking pin section to be inserted into the pin void through the first pin window and the second locking pin section to be inserted into the pin void through the second pin window.

7. A system as recited in claim 1, in which:

the wall panel comprises an array of bars;

the loop portion of the anchor mesh extends through the array of bars; and the locking pin extends through the loop portion on a side of the array of bars opposite the anchor bearing bar.

8. A system as recited in claim 7, in which the wall panels are arranged such that a lower edge of a first wall panel overlaps an upper edge of a second wall panel located below the first wall panel, where the loop portion of the anchor mesh extends through the arrays of bars forming the first and second panels.

9. A system as recited in claim 8, in which the lower edge of the first wall panel and the upper edge of the second wall panel are arranged between the locking pin and the anchor bearing bar when the locking pin extends through the loop portion of the anchor mesh.

10. A method of stabilizing an earthen wall comprising the steps of:

providing anchor mesh comprising a plurality of anchor bars each having a proximal end;

bending the anchor bars adjacent to the proximal ends to form loop portions;

rigidly connecting an anchor bearing bar to the anchor bars between the loop portions and the proximal ends;

arranging the anchor mesh on a first layer of the earthen wall with the loop portion extending slightly beyond a face of the earthen wall;

providing a wall panel;

arranging the anchor mesh such that the anchor mesh is placed on top of a first layer of the earthen wall, and the loop portions of the anchor bars extend through at least a portion of the wall panel with the anchor bearing bar spaced a predetermined distance from a back surface of the wall panel to facilitate insertion of a locking pin through the loop portions;

inserting the locking pin through the loop portion of the anchor mesh such that at least a portion of the wall panel is arranged between the locking pin and the anchor bearing bar; and forming a second layer of the earthen wall to cover the anchor mesh; and predetermining a distance between the loop portions and the anchor bearing bar such that, when the earthen wall acts on the wall panel, the loop portion of the anchor mesh deforms until the anchor bearing bar engages the back surface of the wall panel to maintain a position of the wall panel relative to the anchor mesh and thereby stabilize at least a portion of the earthen wall.

11. A method as recited in claim 10, further comprising the step of assembling a plurality of wall panels to form a retaining wall assembly that stabilizes the earthen wall.

12. A method as recited in claim 10, in which the wall panels are concrete members and a plurality of locking pins are provided, further comprising the steps of:

forming a connecting void network in each of the wall panels, where the connecting void networks comprise a pin void and a plurality of mesh voids;

inserting the loop portions of the anchor mesh into the mesh voids such that the loop portions are aligned with pin voids; and inserting the locking pins into the pin voids and thus through the loop portions.

13. A method as recited in claim 12, in which the step of inserting the locking pins into the pin voids comprises the steps of:

forming the connecting void network such that it comprises first and second pin windows;

providing first and second locking pins for each wall panel;

arranging the wall panels such that the pin windows on adjacent wall panels are aligned;

laterally displacing the first and second locking pins such that they enter a pair of aligned pin windows; and displacing the first and second locking pins along their axes towards each other.

14. A method as recited in claim 10, further comprising the step of forming the anchor mesh such that a distance between the anchor bearing bar and a portion of the anchor mesh that engages the locking pin allows the locking pin to be inserted through the loop portion during assembly but decreases by a controlled amount due to forces introduced on the wall panels during the process of forming the layers of the earthen wall.

15. A method as recited in claim 10, in which the wall panels comprise wire mesh, further comprising the steps of:

arranging the wall panels such that a lower edge of a first wall panel overlaps and upper edge of a second wall panel;

inserting the loop portions of the anchor mesh through the lower edge of the first wall panel and the upper edge of the second wall panel arranged below the first wall panel; and inserting the locking pins through the loop portions such that the lower edge of the first wall portion and the upper edge of the second wall portion are spaced between the locking pins and the anchor bars.

16. A method as recited in claim 15, further comprising the step of arranging construction fabric between the wall panels and the face of the earthen wall.

17. A retaining wall system for stabilizing an earthen wall, comprising:

a plurality of wall panels assembled together to form a retaining wall that engages a face of the earthen wall, the wall panels being concrete members each having a connecting void network cast therein, where the connecting void networks comprise a pin void, a plurality of mesh voids, and first and second pin windows and the wall panels are arranged adjacent to each other such that a pin window of one of the wall panels is adjacent to a pin window of another of the wall panels;

anchor mesh buried within the earthen wall, the anchor mesh comprising a plurality of anchor bars each having a proximal end and the anchor bars are bent adjacent to the proximal ends to form a plurality of loop portions, where the loop portions are each inserted into one of the mesh voids; and a plurality of locking pins, where each locking pin is inserted into a pin void and through the loop portions of the anchor mesh such that the locking pin engages the wall panel and the loop portions of the anchor mesh to maintain a position of the wall panel relative to the anchor mesh and thereby stabilize at least a portion of the earthen wall; wherein when the wall panels are assembled to form the retaining wall, the adjacent pin windows of adjacent wall panels allow the locking pins to be inserted into the pin voids.

18. A system as recited in claim 17, further comprising an anchor bearing bar attached to the loop portions of the anchor mesh, where the anchor bearing bar is configured to engage a rear surface of the wall panel when the earthen wall is formed.

19. A system as recited in claim 17, in which a length of the pin window is slightly longer than half of a length of one of the locking pins.

20. A method of stabilizing an earthen wall comprising the steps of:

providing anchor mesh comprising a plurality of anchor bars each having a proximal end;

bending the anchor bars adjacent to the proximal ends to form loop portions;

arranging the anchor mesh on a first layer of the earthen wall with the loop portion extending slightly beyond a face of the earthen wall;

providing a wall panel;

forming in the wall panel a connecting void network comprising first and second pin windows;

arranging the wall panels such that the pin windows on adjacent wall panels are aligned;

arranging the anchor mesh such that the anchor mesh is placed on top of a first layer of the earthen wall, and the loop portions of the anchor bars extend through at least a portion of the wall panel;

providing first and second locking pins;

laterally displacing the first and second locking pins such that they enter a pair of aligned pin windows;

displacing the first and second locking pins along their axes towards each other through at least one of the loop portions;

forming the earthen wall such that the wall panels engage and stabilize the earthen wall.

21. A method as recited in claim 20, further comprising the step of assembling a course of wall panels before the locking pins are laterally displaced into the pair of aligned pin windows.

22. A method as recited in claim 20, in which the wall panels are concrete members, further comprising the steps of:

forming the connecting void networks in the wall panels such that each connecting void network comprise a pin void and a plurality of mesh voids;

inserting the loop portions of the anchor mesh into the mesh voids such that the loop portions are aligned with the pin voids; and inserting the locking pins into the pin voids and thus through the loop portions.

23. A method as recited in claim 20, further comprising the step of rigidly connecting an anchor bearing bar to the anchor bars between the loop portions and the proximal ends of the anchor bars such that a distance between the anchor bearing bar and a portion of the anchor mesh that engages the locking pin allows the locking pin to be inserted through the loop portion during assembly but decreases by a controlled amount due to forces introduced on the wall panels during the process of forming the layers of the earthen wall.

* * * * *